United States Patent [19]

Murphy et al.

[11] Patent Number: 4,638,869

[45] Date of Patent: Jan. 27, 1987

[54] BULLDOZER BLADE MOUNTING AND STABILIZING ARRANGEMENT

[75] Inventors: Michael J. Murphy, Peoria; Kent D. Smith, Mapleton, both of Ill.

[73] Assignee: Caterpillar Inc., Peoria, Ill.

[21] Appl. No.: 851,847

[22] Filed: Apr. 14, 1986

[51] Int. Cl.[4] ..... E02F 3/76

[52] U.S. Cl. ..... 172/821

[58] Field of Search ..... 172/820, 821, 823, 822, 172/824, 825

[56] References Cited

U.S. PATENT DOCUMENTS

| | | | |
|---|---|---|---|
| 2,749,630 | 6/1956 | Nave | 172/821 |
| 3,529,678 | 9/1970 | Teasdale | 172/821 |
| 3,631,930 | 1/1972 | Peterson | 172/821 |
| 3,991,832 | 11/1976 | Cooper | 172/821 |
| 4,081,036 | 3/1978 | Yokoyama | 172/821 |
| 4,281,721 | 8/1981 | Beales | 172/821 |
| 4,364,439 | 12/1982 | Asal | 172/821 |
| 4,424,871 | 1/1984 | Stickney | 172/821 |
| 4,562,891 | 1/1986 | Ranner | 172/821 |

FOREIGN PATENT DOCUMENTS 1115514 1/1982 Canada .

*Primary Examiner*—Richard J. Johnson
*Attorney, Agent, or Firm*—J. W. Burrows

[57] ABSTRACT

Mounting arrangements are required to mount and stabilize a bulldozer blade on a vehicle when it is desirable to both angle and tilt the bulldozer blade relative to the vehicle. During the angling and tilting of the bulldozer blade, it is desirable to control the pitch of the blade without inducing unnecessary stresses in the mounting arrangement or high cylinder pressures in the angle cylinders. The present mounting arrangement includes a bracket apparatus which is utilized to allow normal pitching of the bulldozer blade but limit any abnormal pitching thereof during tilting and/or angling thereof. The bracket apparatus utilizes a first bracket assembly secured to a mounting frame and having a transverse slot defined therein. The bracket apparatus further includes a second bracket assembly secured to a rear central portion of the bulldozer blade and has a pin assembly secured thereto and disposed in the transverse slot. The pin assembly being disposed in the slot merely follows the slot during normal tilting and angling of the bulldozer blade but limits the degree of pitch whenever the bulldozer blade tries to abnormally pitch. This arrangement is simple in construction and is readily retrofitted to current mounting arrangements. Furthermore, it provides a positive pitch control of the bulldozer blade relative to the mounting frame without inducing any high stresses in the mounting frame and/or high pressures in the angling cylinders.

12 Claims, 3 Drawing Figures

BULLDOZER BLADE MOUNTING AND STABILIZING ARRANGEMENT

TECHNICAL FIELD

This invention relates generally to a mounting arrangement for supporting and stabilizing a bulldozer blade on a vehicle and more particularly to limiting the amount of pitch that the bulldozer can have during angling and tilting thereof.

BACKGROUND ART

Various arrangements have been used in the past to control the pitch of a bulldozer blade during angling and tilting thereof. In some of these arrangements, the bulldozer blade is prohibited from pitching during tilting consequently inducing high pressures in the angling cylinders and/or high stresses in the structure itself. It is advantageous to provide an arrangement that would be simple in construction and would also allow for retrofitting of the mechanism on existing bulldozer blade arrangements. Furthermore, in some of the mounting arrangements currently used there is no provision for compensating for manufacturing tolerances that exist during assembly of the various components.

U.S. Pat. No. 3,631,930 which issued on Jan. 4, 1972 to Robert A. Peterson teaches a bulldozer blade mounting arrangement having a C-frame which is pivotably connected at the ends thereof to opposite sides of a tractor and having the lower rear center of the bulldozer blade connected to the front mid portion of the C-frame by a universal connection. The blade angling and pitching of this arrangement is controlled by a pair of hydraulic jacks connected to the C-frame and connected at respective locations to the back of the bulldozer blade thus providing a simplified three point mounting of the blade to the C-frame. The tilting of the blade relative to the C-frame is accomplished by a hydraulic cylinder connected to the central portion of the C-frame vertically disposed from the universal connection and to one side of a rear portion of the bulldozer blade. In this arrangement, the pitching of the blade is solely controlled by the angle cylinders. However, if the angling cylinders would happen to drift or get out of phase due to air in the cylinders or the lines, or due to oil seepage around the piston of the cylinder, the blade could pitch forwardly or rearwardly during operation and unnecessarily affect the bulldozing capability of the bulldozer blade.

In order to correct the above-noted problem of having no positive pitch control, others have provided various forms of positive retention pitch controls. For example, U.S. Pat. No. 3,991,832 which issued July 14, 1975 to Phillip Clinton Cooper discloses a bulldozer arrangement quite similar to that noted above relative to U.S. Pat. No. 3,631,930. In this arrangement, the lower rear central portion of the bulldozer blade is connected to a front central portion of a C-frame by a universal connection. The angling of the bulldozer blade is accomplished by a pair of cylinders connected between either side of the C-frame and the opposed ends of the bulldozer blade. The tilting of the blade is accomplished by a tilt cylinder connected between the C-frame and one end of the bulldozer blade in a vertically spaced relation to the universal connection. Furthermore, in this arrangement a positive pitch retention control is provided. This pitch control includes a bracket assembly secured to the back top central portion of the bulldozer blade and has a groove included therein and a slide member that is attached to the top central portion of the C-frame and is slidably disposed in the groove to ensure that the blade is not allowed to pitch any during tilting thereof. Since this arrangement does not allow the blade to pitch at all during tilting thereof, extra high forces are subjected to the angling cylinders consequently creating high pressure levels in the angling cylinders. In order to overcome this problem, a specialized relief arrangement was provided in the hydraulic circuitry to offset the high pressure levels that were being induced. Furthermore, this arrangement requires close control during manufacturing thereof to offset any manufacturing tolerances which may create binding thereof during assembly.

U.S. Pat. No. 4,424,871 which issued May 17, 1982 to Douglas B. Stickney teaches an improvement to minimize or avoid the high pressure levels which were induced in the angling cylinders of the above-noted U.S. Pat. No. 3,991,832. In this arrangement, as in the previous patents, the bulldozer blade is connected to a C-frame by a universal connection and the angling of the blade is controlled by two angling cylinders while the tilting thereof is controlled by a tilt cylinder connected between an upper portion of the C-frame and the backside of the bulldozer blade. This arrangement also includes a positive pitch control mechanism that does not allow the blade to pitch during tilting thereof. This arrangement includes a bracket having a groove therein secured to the C-frame and another bracket secured to the blade having a follower disposed in the groove of the first bracket to positively prohibit the blade from pitching during tilting thereof. In order to offset the high pressures that normally would be subjected to the angling cylinders during tilting, special efforts were made to connect the angling cylinders to the C-frame in a precise arrangement such that the points of connection of the angling cylinders to the C-frame falls in a straight line with the center of the universal joint. This arrangement requires a more precise control during manufacturing to correctly position the angling cylinders and would not allow ready retrofitting of the mechanism to an existing bulldozer blade mounting arrangement.

Canadian Pat. No. 1,115,514 which issued on Jan. 5, 1982 to Yokoyama et al teaches another arrangement for positively controlling the pitch of the bulldozer blade during angling and tilting thereof. In this mounting arrangement, the rear lower central portion of the bulldozer blade is connected to a front central portion of a C-frame by a universal joint. The angling of the bulldozer blade is controlled by a pair of angling cylinders connected between opposite sides of the C-frame and opposed end portions of the bulldozer blade while the tilting is controlled by a cylinder connected to the central upper portion of the C-frame and the back side of the bulldozer blade in a vertically spaced relation to universal connection. The positive pitch control in this arrangement is accomplished by a link or rod connected between a bracket on the top central portion of the bulldozer blade and a bracket on the top central portion of the C-frame. In this arrangement the rod connections do not have any built-in looseness. During tilting of the blade in this subject arrangement, the blade will automatically pitch as determined by the length of the rod which securely interconnects the C-frame and the bulldozer blade. If the length of the rod was not precise and accurately positioned, the blade would not be allowed to pitch in a normal manner. Consequently, in order to offset any high pressures in the angling cylinders or stresses in the mounting arrangement the length of the rod would have to be closely controlled and accurately positioned. Therefore, it would also inhibit the ability of easily retrofitting this arrangement to current bulldozer blade mounting arrangements that do not have a positive pitch retention mechanism.

The present invention is directed to overcoming one or more of the problems as set forth above.

DISCLOSURE OF THE INVENTION

In one aspect of the present invention, a mounting arrangement is provided for supporting and stabilizing a bulldozer blade on a vehicle. The mounting arrangement has a longitudinal axis and the bulldozer blade has a rear central portion, rear side portions and is adapted to angle and tilt relative to the longitudinal axis of the mounting arrangement. The mounting arrangement also includes a mounting frame having side members each with one end adapted for pivotable connection to the vehicle and extending longitudinally therefrom and an intermediate member interconnecting the other end of each of the side members; a universal joint connection interconnecting the rear central portion of the blade with the intermediate member of the mounting frame, the universal joint connection defining a center of motion with the longitudinal axis of the vehicle passing through the center of motion; a pair of hydraulic angling cylinders pivotably connected between the mounting frame and the respective rear side portions of the bulldozer blade; and a hydraulic tilt cylinder pivotably connected between the intermediate member of the mounting frame and one of the rear side members of the bulldozer blade in vertically spaced relation to the universal connection. A bracket apparatus connects the intermediate member of the frame and the rear central portion of the blade. The bracket apparatus is vertically spaced from the universal joint connection and has a first bracket assembly secured to one of the intermediate member of the mounting frame and the rear central portion of the bulldozer blade. The first bracket assembly defines a generally transverse slot therein relative to the longitudinal axis with the slot defining a center substantially vertically aligned with the center of motion of the universal joint connection. A second bracket assembly is secured to the other of the intermediate member of the mounting frame and the rear central portion of the bulldozer blade. The second bracket assembly has a pin assembly attached thereto and disposed in the slot of the first bracket assembly substantially coaxial with the center of the slot when the bulldozer blade is in its nontilted position. The pin assembly is freely movable in the transverse slot to allow normal pitching of the bulldozer blade when the bulldozer blade is being tilted.

The present invention provides a mounting arrangement for a bulldozer blade that allows the bulldozer blade to pitch in a normal manner as dictated by the linkage mechanism during tilting thereof but yet controls any unnecessary pitch thereof. The bracket apparatus used in the subject invention is generally simple in construction and easily retrofitted to existing bulldozer arrangements not having any positive pitch control while also providing a mechanism that can offset varying degrees of manufacturing tolerances during assembly without requiring special machining prior to assembly.

BEST MODE FOR CARRYING OUT THE INVENTION

Figure 1:
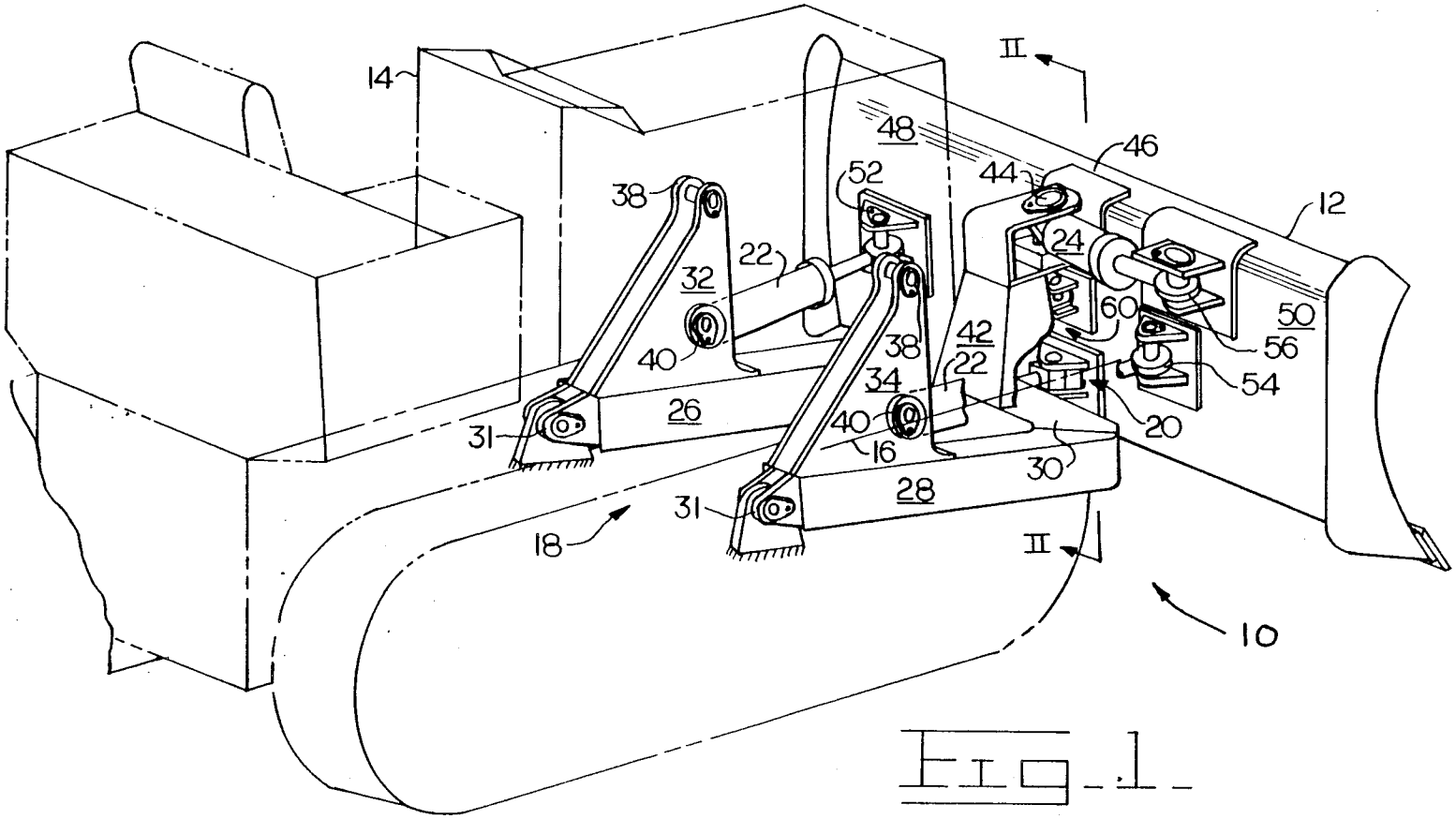
FIG. 1 is a diagrammatic perspective representation of a mounting arrangement for a bulldozer blade to a tractor incorporating an embodiment of the present invention.

Referring now to the drawings, and more particularly to FIG. 1, a mounting arrangement 10 is shown for supporting and stabilizing a bulldozer blade 12 to a vehicle 14.

The mounting arrangement 10 has a longitudinal axis 16 and includes a mounting frame 18, a universal joint connection 20, a pair of hydraulic angling cylinders 22, and a hydraulic tilt cylinder 24.

The mounting frame 18 is composed of a pair of longitudinally extending side members 26,28 and an intermediate member 30 which is securely fastened to one of the ends of each side member 26,28 to form a C-frame structure. The other end 31 of the side members are universally secured to the vehicle 14 in a conventional manner and adapted to pivot relative to the vehicle. Respective bracket members 32,34 are secured to and extend vertically upward from the respective side members 26,28 adjacent the connection of the side members to the vehicle. Each of the bracket members 32,34 include upper and lower mounting assemblies 38,40 adapted to connect hydraulic cylinders thereto. The upper mounting assembly 38 is used to connect respective lift cylinders, not shown, to the vehicle 14 for raising and lowering of the bulldozer blade 12 by pivoting mounting frame 18 about the pivot connections 31.

Another bracket member 42 is secured to the intermediate member 30 and extends vertically upwards relative thereto. The bracket member 42 has a mounting assembly 44 located at the top thereof.

The bulldozer blade 12 includes a rear central portion 46 and opposed rear side portions 48,50. Respective mounting assemblies 52,54 are secured to the opposed rear side portions of the bulldozer blade 12 by any conventional manner such as by welding and are adapted to connect the hydraulic angling cylinders 22 thereto. Another mounting assembly 56 is secured in a conventional manner to one of the opposed rear side portions 50 and also adapted to connect the hydraulic tilt cylinder 24 thereto. The universal joint connection 20 of the mounting arrangement 10 interconnects the rear central portion 46 of the bulldozer blade 12 with the intermediate member 30 of the mounting frame 18. The universal joint connection defines a center of motion 58 at which any motion of the bulldozer blade relative to the mounting frame is generated about the center of motion. The universal joint connection 20 and the mounting assembly 44 are substantially generally vertically aligned. Furthermore, the center of motion 58 of the universal joint connection 20 is vertically aligned with the center of the mounting assembly 44.

The pair of hydraulic angling cylinders 22 are respectively connected between the respective lower mounting assemblies 40 of the mounting frame 18 and the respective mounting assembly 52,54 located on the rear of the bulldozer blade 12. The pair of angling cylinders 22 are adapted to angle the bulldozer blade 12 relative to the mounting frame 18.

The hydraulic tilt cylinder 24 is connected between the mounting assembly 44 located on top of the bracket member 42 and the mounting assembly 56 located on the rear side portions 50 of the bulldozer blade 12. The tilt cylinder 24 is adapted to tilt the bulldozer blade 12 relative to the mounting frame 18 by extension and retraction thereof.

Figures 2, 3:
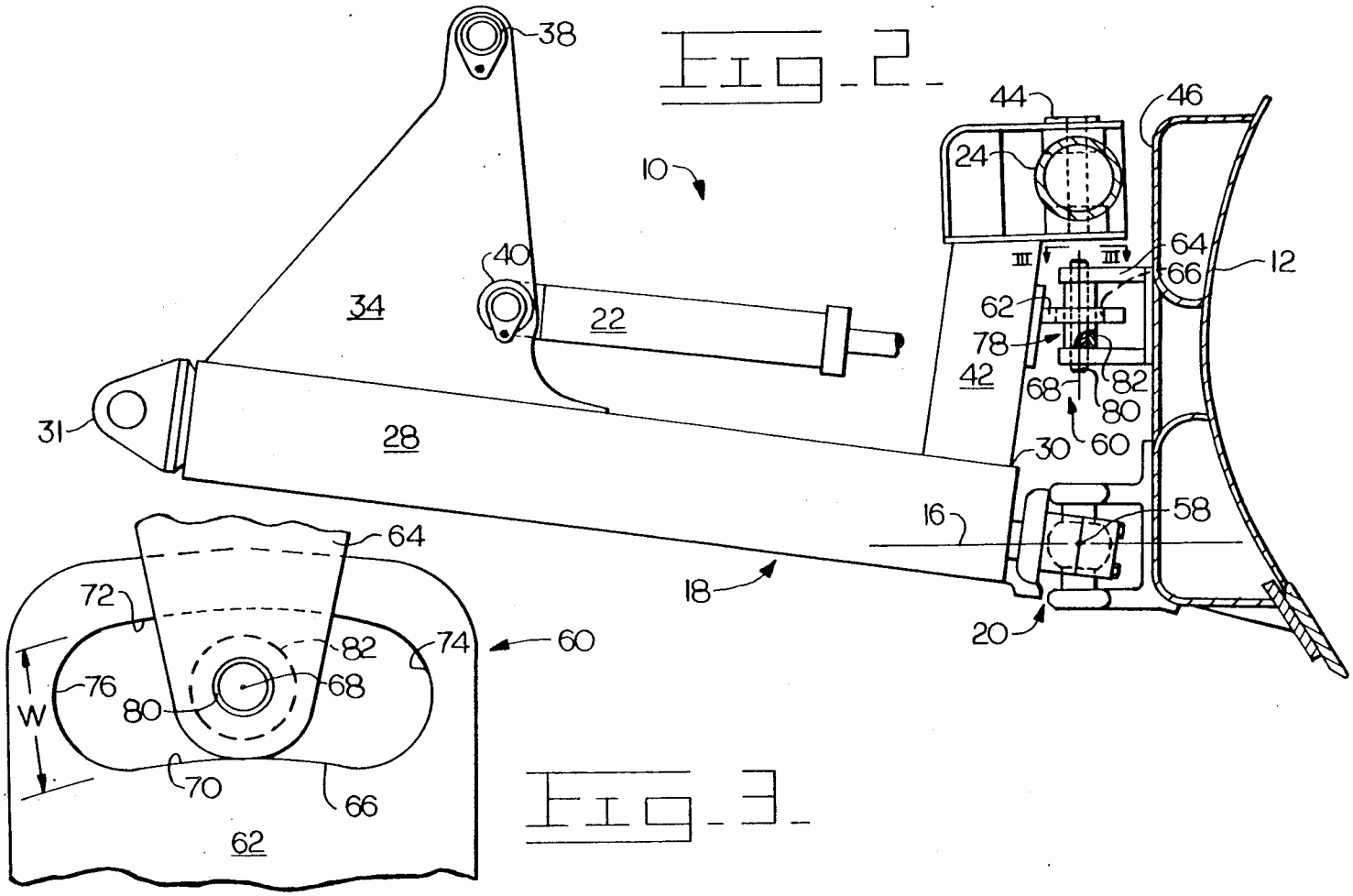
FIG. 2 is a side view of the mounting arrangement illustrating in greater detail the structure of the present invention.
FIG. 3 is a partial plan view taken from FIG. 2 along the lines III—III illustrating in more detail the embodiment of the present invention.

The mounting arrangement also includes a bracket apparatus 60 which is connected between bracket member 42 of the intermediate member 30 and the rear central portion 46 of the bulldozer blade 12. As seen more clearly in FIGS. 2 and 3, the bracket apparatus 60 includes first and second bracket assemblies 62,64. The first bracket assembly 62 defines a generally transverse slot 66 secured to the bracket member 42 of the intermediate member 30 in any conventional means, such as by welding. The generally transverse slot 66 is non-linear and in this embodiment is an arcuate slot. The arcuate slot 66 has a radius defined by the normal pitch of the bulldozer blade during tilting thereof. A center 68 of the arcuate slot 66 is defined in the first bracket assembly 62. The arcuate slot has side surfaces 70,72 and the distance between the side surfaces 70,72 establishes a predetermined width (W). The arcuate slot also has opposite ends 74,76 and the center 68 of the slot 66 is nearer the rear central portion 46 of the bulldozer blade 12 than the opposite ends 74,76 thereof when in the normal installed position.

The second bracket assembly 64 includes a pin assembly 78 having a cross section that is narrower than the width (W) of the arcuate slot 66. The pin assembly 78 includes a shaft 80 which is retained in the second bracket assembly 64 and has a cylindrical roller 82 rotatably retained thereon. The pin assembly 78 is disposed in the arcuate slot 66 and adapted to allow limited pitch of the bulldozer blade 12 during tilting thereof.

It is recognized that the first bracket assembly 62 could be secured to the rear central portion of the bulldozer blade and the second bracket assembly secured to the bracket member 42 of the intermediate member 30 without departing from the essence of the invention. Furthermore, it is recognized that even though the cylindrical roller 82 of the pin assembly 78 is smaller than the width (W) of the arcuate slot 66, it would be possible for the diameter of the cylindrical roller to be substantially the same as that of the width (W) of the arcuate slot 66. In the non-tilted position of the bulldozer blade 12, the center of motion 58 of universal joint connection 20, the center 68 of the arcuate slot 66, and the center of the pin assembly 78 are in substantial vertical alignment. In the arrangement set forth herein, the bracket apparatus 60 is located between the universal joint connection 20 and the tilt cylinder 24 connection with the intermediate member 30.

Industrial Applicability

During operation of the bulldozer blade 12 attached to the subject mounting arrangement 10, the bulldozer blade is angled and tilted as operating conditions require. During angling of the bulldozer blade, one of the pair of hydraulic angling cylinders 22 extend while the other one retracts and the bulldozer blade articulates about the center of motion 58 of the universal joint connection 20. The tilt cylinder 24 merely turns with the bulldozer blade 12 since the tilt cylinder 24 is connected to the bracket member 42 through the mounting assembly 44 and the mounting assembly 44 is vertically located substantially above the center of motion 58 of the universal joint connection 20. Furthermore, during the angling of the bulldozer blade 12, the pin assembly 78 of the second bracket assembly 64 secured to the rear central portion 64 of the bulldozer blade 12 merely rotates about the center 68 of the transverse slot 66 since the pin assembly and the center 68 of the slot are both in vertical alignment with the center of motion 58 of the universal joint connection 20.

During tilting of the bulldozer blade 12, the tilt cylinder 24 is extended or retracted depending on operating conditions. The bulldozer blade 12 articulates about the center of motion 58 of the universal joint connection 20 during the tilting thereof. Due to the geometry of the connection of the angling cylinders between the bulldozer blade 12 and the mounting frame 18, the bulldozer blade 12 normally pitches rearwardly during tilting thereof. As the bulldozer blade 12 is being tilted, the pin assembly 78 moves from the center 68 of the slot 66 towards one of the opposite ends 74/76. Since, in the embodiment shown, the slot is arcuate and has a radius defined by the normal pitch of the blade during tilting, the pin assembly 78 does not offer any resistance to the tilting of the bulldozer blade 12. However, if the bulldozer blade 12 would happen to attempt to pitch in a manner out of the ordinary, the pin assembly 78 would contact one of the side surfaces 70/72 and limit the undesired pitch of the blade during the tilting cycle. Consequently, it should be apparent that during normal blade operation, the bracket apparatus 60 is non-functional and is only functional when the bulldozer blade 12 attempts to pitch more than the normal allowance thereof.

When the bulldozer blade 12 is tilted relative to the mounting frame 18, it may still be angled since the pin assembly 78 is still vertically aligned with the center of motion 58 of universal joint connection 20.

The mounting arrangement 10, as set forth above, provides a mounting mechanism that is simple in construction and provides the stabilizing of the bulldozer blade 12 without having to have complicated precisely machined structure on the total arrangement. The bracket apparatus 60 can also be retrofitted to existing mounting arrangements that do not have have positive pitch retaining devices. By having the pin assembly 78 located in the slot 66 that has the width (W) wider than the diameter of the cylindrical roller 82 of the pin assembly 78, the stack up of manufacturing tolerances can be absorbed without inducing unnecessary stresses in the mounting arrangement or high pressures in the angling cylinders. Also, by having the transverse slot 66 arcuate in shape with a radius as defined by the normal pitch of the bulldozer blade 12 during tilting, the bracket apparatus 60 doesn't serve as a guide it merely serves as an apparatus to limit abnormal pitch of the bulldozer blade 12.

Other aspects, objects and advantages of this invention can be obtained from a study of the drawings, the disclosure and the appended claims.

We claim:

1. In a mounting arrangement adapted for supporting and stabilizing a bulldozer blade on a vehicle, said mounting arrangement having a longitudinal axis and said bulldozer blade having a rear central portion, rear side portions and being adapted to angle and tilt relative to the longitudinal axis of said mounting arrangement, said mounting arrangement also including a mounting frame having side members each with one end adapted for pivotable connection to the vehicle and extending longitudinally therefrom, and an intermediate member interconnecting the other end of each of the side members; a universal joint connection interconnecting the rear central portion of the blade with the intermediate member of the mounting frame, said universal joint connection defining a center of motion with said longitudinal axis of the vehicle passing through said center of motion; a pair of hydraulic angling cylinders pivotably connected between the mounting frame and the respective rear side portions of the bulldozer blade; and a hydraulic tilt cylinder pivotably connected between the intermediate member of the mounting frame and one of the rear side portions of the bulldozer blade and in vertically spaced relation to said universal joint connection, the improvement comprising:

a bracket apparatus connected between the intermediate member of the mounting frame and the rear central portion of the bulldozer blade, said bracket apparatus being vertically spaced from the universal joint connection and having a first bracket assembly secured to one of said intermediate member of the mounting frame and said rear central portion of the bulldozer blade, said first bracket assembly defining a generally transverse slot therein relative to said longitudinal axis, said slot defining a center substantially vertically aligned with the center of motion of the universal joint connection; and a second bracket assembly secured to the other of the intermediate member of the mounting frame and the rear central portion of the bulldozer blade, said second bracket assembly having a pin assembly attached thereto and disposed in the slot of the first bracket assembly substantially coaxially with the center of said slot when the bulldozer blade is in its non-tilted position, said pin assembly being freely movable in said slot to allow normal pitching of the bulldozer blade when said bulldozer blade is being tilted.

2. The mounting arrangement, as set forth in claim 1, wherein the transverse slot has a width and the pin assembly has a cross section smaller in size than the width of the slot to allow said normal pitch of the bulldozer blade during tilting thereof.

3. The mounting arrangement, as set forth in claim 2, wherein the generally transverse slot is non-linear.

4. The mounting arrangement, as set forth in claim 3, wherein the non-linear slot is an arcuate slot and has a radius defined by the normal pitch of the bulldozer blade during tilting thereof.

5. The mounting arrangement, as set forth in claim 1, wherein the generally transverse slot is non-linear.

6. The mounting arrangement, as set forth in claim 5, wherein the non-linear slot defines opposite ends and the center of the non-linear slot is nearer the rear central portion of the bulldozer blade than the opposite ends thereof when in the normal install position.

7. The mounting arrangement, as set forth in claim 6, wherein the non-linear slot is an arcuate slot.

8. The mounting arrangement, as set forth in claim 7, wherein the arcuate slot has a radius defined by the normal pitch of the bulldozer blade during tilting thereof.

9. The mounting arrangement, as set forth in claim 8, wherein said pin assembly includes a shaft secured to the second bracket assembly and a cylindrical roller rotatably retained on the shaft and disposed in the arcuate slot of the first bracket assembly to allow said normal pitch of the bulldozer blade during tilting thereof.

10. The mounting arrangement, as set forth in claim 9, wherein the first bracket assembly is secured to the intermediate member of the mounting frame and the second bracket assembly is secured to the rear central portion of the bulldozer blade.

11. The mounting arrangement, as set forth in claim 10, wherein the transverse slot has side surfaces and the distance between the side surfaces establishes a predetermined width and the roller of the pin assembly has a diameter smaller than the predetermined width of the transverse slot to provide clearance between the roller of the pin assembly and the transverse slot so that during assembly the stack-up of manufacturing tolerances does not cause binding therebetween.

12. The mounting arrangement, as set forth in claim 11, wherein the bracket apparatus is vertically located between the universal joint connection and the connection of the tilt cylinder with the intermediate member of the mounting frame.

* * * * *